United States Patent [19]

Salazar

[11] Patent Number: 4,956,069

[45] Date of Patent: Sep. 11, 1990

[54] ELECTROLYTIC MEMBRANE CELLS FOR THE PRODUCTION OF ALKALIS

[76] Inventor: Hermilo Tamez Salazar, Ave. Lagrange 108 Fracc. Colonial Lagrange 66490, San Nicolas, De Los Garza, N. L., Mexico

[21] Appl. No.: 321,304

[22] Filed: Mar. 10, 1989

[51] Int. Cl.[5] ..... C25B 9/00; C25B 11/03; C25B 11/10

[52] U.S. Cl. ..... 204/257; 204/279; 204/290 F; 204/283; 204/284; 204/263

[58] Field of Search ..... 204/256, 258, 290 F, 204/283, 284, 263-266, 252-255, 257, 279

[56] References Cited

U.S. PATENT DOCUMENTS

| | | | |
|---|---|---|---|
| 3,591,483 | 7/1971 | Loftfield et al. | 204/283 X |
| 3,891,531 | 6/1975 | Bouy et al. | 204/290 F X |
| 4,118,306 | 10/1978 | DeNora et al. | 204/290 F X |
| 4,271,004 | 6/1981 | Cunningham et al. | 204/283 X |
| 4,378,286 | 3/1983 | Eng et al. | 204/290 F X |
| 4,534,846 | 8/1985 | Woodard, Jr. et al. | 204/284 X |
| 4,695,359 | 9/1987 | Woodard et al. | 204/290 F X |

*Primary Examiner*—Donald R. Valentine
*Attorney, Agent, or Firm*—Laurence R. Brown

[57] ABSTRACT

Electrolytic membrane cells for use in the production of alkalis are provided. A central anode reservoir chamber (1) has titanium (12) spread in sheets on opposite sides for electrolytic reaction with two cathode reservoir chambers (7) to form a monopolar cell. Each cathode has a porous tin sheet (8). The respective cathode chambers (7) are separated from the anode chamber (1) by diaphragm (6). Raw materials are fed through hydraulic pipes in the bottom of the cell and processed products are withdrawn from a chamber at the top of the anode chamber 1 where gases may accumulate.

2 Claims, 2 Drawing Sheets

ELECTROLYTIC MEMBRANE CELLS FOR THE PRODUCTION OF ALKALIS

BACKGROUND OF THE INVENTION

Up to now there are several kinds of electrolytic membrane cells for the production of alkalis, using for their construction highly sophisticated materials for the Mexican environment, mostly because said materials are very expensive to purchase and as a consequence any technology related to the same shall be very expensive for the Mexican industrial environment. So, one of the objectives of this invention is to provide cheaper ingredient, more effective in operation and more practical to use.

One of the advantages of this invention relies in the fact that this improved cell is highly efficient in the use of electrical current in the electrochemical reaction, to produce advantages over prior art cells.

Another advantage of this invention is to permit the possibility of obtaining sodium hydroxide, potassium hydroxide and chlorine gas as well as similar components with lower manufacturing cost than obtained when using other kinds of cells, such as those coming from highly industrialized countries where the economic cost is not significant. This is a significant advantage for those countries involved in this industry with low economic potential.

As shall be shown herein these electrolytic membrane cells for the production of alkalis, are manufactured according to a very simple design, showing versatility of use (with which several different products can be obtained, such as chlorine-soda, chlorine-potash), and have a high level of reaction efficiency, with low maintenance cost. The cells are useful in operating systems with advantage of providing maintenance without hindering the other cells which are operating together with the one under maintenance.

DESCRIPTION OF THE INVENTION

Figure 1:
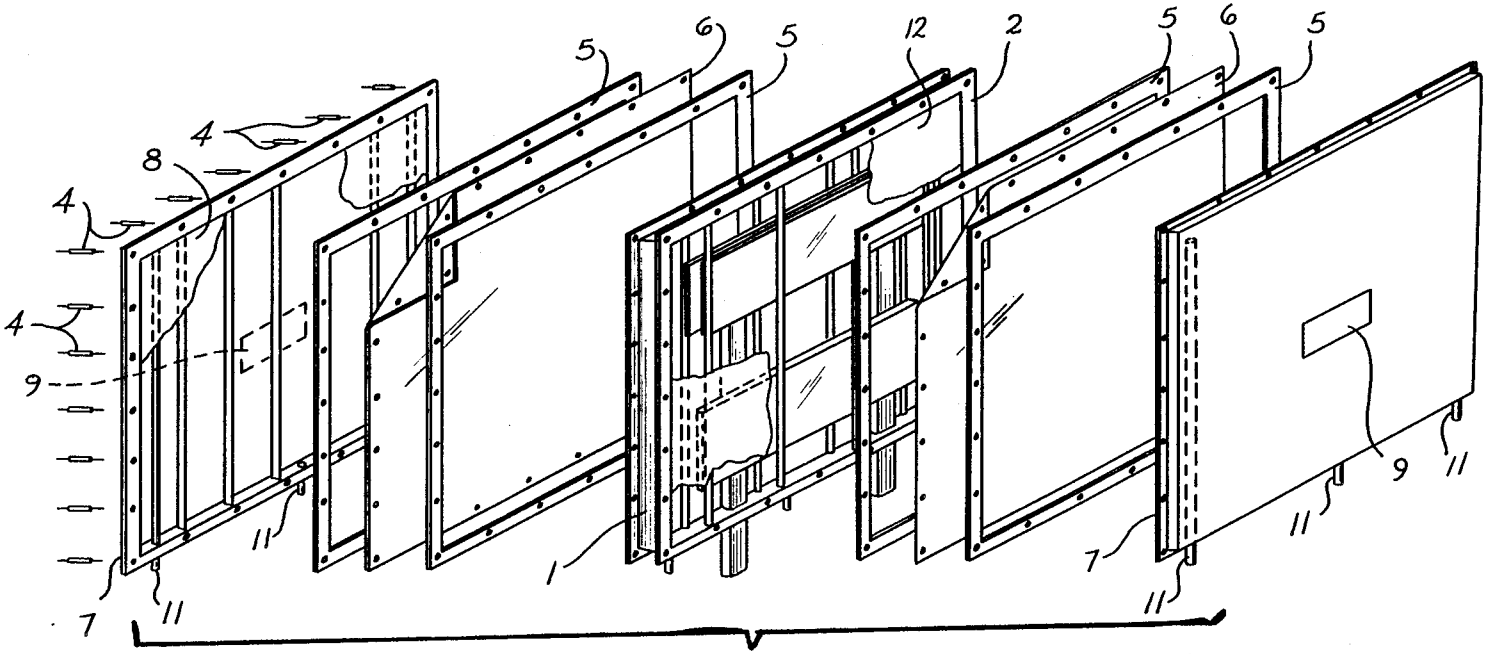
FIG. 1 is an exploded view of a cell.
Figure 2:
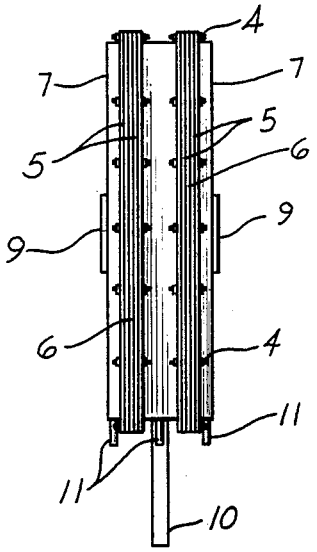
FIG. 2 is a side view sketch showing the working parts assembled.
Figure 3:
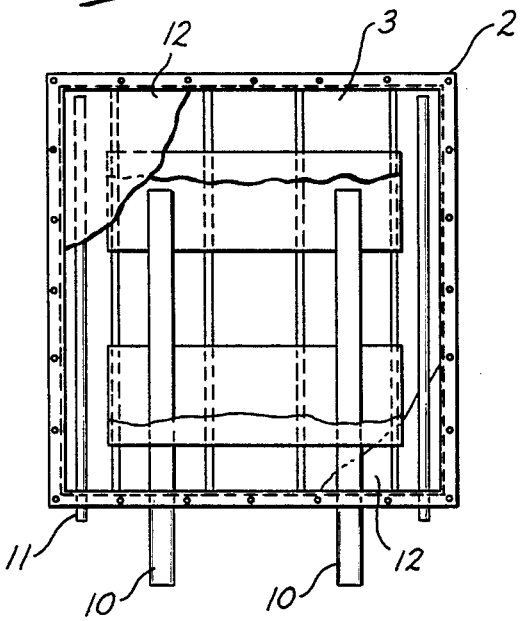
FIG. 3 is a front view sketch of the cell partly broken away, showing construction details in phantom.

Referring to the figures, this electrolytic membrane cell for the production of alkalis is made up with a central anode compartment having titanium (12) spread as layers on two sheets (2) combining an anodic reservoir compartment reinforced with structural or cast iron material (1) covered with titanium the anodic compartment has proper structure in the upper part forming a space for accumulating gases (3).

The cathodes (7), built of structural or cast iron material frame for a welded and drilled tin sheet (8) are held together in the central reservoir compartment by means of covered stud bolts (4), seals (5) and membranes (6), thus forming two•cathode reservoir compartments. On the outer sides the contacts (9) are welded, to supply the current, which passes through the electrolytic solution and out through the connecting anode bars (10), for the continuation of the circuit in order to obtain the electrolytic reaction.

The hydraulic connections (11), are used to feed the raw materials and to unload the product of the reaction.

I claim:

1. An electrolytic membrane self contained sealed cell for the production of alkalis, comprising in combination, a central anode compartment located between two cathode compartments to form a monopolar cell structure, anode compartment structure providing two opposed sheets comprising titanium spread in a layer with reinforcing structure forming a compartment which defines in an upper part a space for accumulation of reaction gases, cathode compartment structures respectively comprising an outer perforated tin plate and a diaphragm disposed toward said anode sheets respectively, electrical current terminals respectively connected to the titanium sheets and tin plates, assembling means holding the sheets and plates in spaced relationship to define a sealed self combined electrolytic cell, and hydraulic pipe means for introducing raw materials into the cell and removing processed products.

2. The cell defined in claim 1 wherein the assembling means further comprises, flat rim structure peripherally disposed about anode and cathode elements forming the cell with registered bolt receiving apertures, and stud bolts holding the elements together to form a sealed cell.

* * * * *